US008488830B2

(12) United States Patent
Yoshino

(10) Patent No.: US 8,488,830 B2
(45) Date of Patent: Jul. 16, 2013

(54) CONDENSER MICROPHONE HAVING A FLEXIBLE NECK

(75) Inventor: Satoshi Yoshino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 201 days.

(21) Appl. No.: 12/929,831

(22) Filed: Feb. 18, 2011

(65) Prior Publication Data

US 2011/0206221 A1 Aug. 25, 2011

(30) Foreign Application Priority Data

Feb. 22, 2010 (JP) ..... 2010-035903

(51) Int. Cl.
*H04R 11/04* (2006.01)
*H04R 25/00* (2006.01)

(52) U.S. Cl.
USPC ..... 381/363; 381/189

(58) Field of Classification Search
USPC ..... 381/174, 189, 361, 363, 369, 355, 381/356, 362, 366; 361/816, 818
See application file for complete search history.

(56) References Cited

U.S. PATENT DOCUMENTS

| | | | | |
|---|---|---|---|---|
| 7,447,326 | B2 * | 11/2008 | Akino | 381/363 |
| 7,580,735 | B2 * | 8/2009 | Akino | 455/575.1 |
| 2005/0254670 | A1 * | 11/2005 | Akino | 381/113 |
| 2005/0254679 | A1 * | 11/2005 | Akino | 381/390 |
| 2006/0002575 | A1 * | 1/2006 | Akino | 381/361 |
| 2006/0013428 | A1 * | 1/2006 | Akino | 381/369 |
| 2006/0251274 | A1 * | 11/2006 | Akino | 381/111 |
| 2008/0063232 | A1 * | 3/2008 | Song | 381/355 |
| 2011/0266087 | A1 * | 11/2011 | Akino | 181/158 |

* cited by examiner

*Primary Examiner* — Fan Tsang
*Assistant Examiner* — Eugene Zhao
(74) *Attorney, Agent, or Firm* — Manabu Kanesaka

(57) ABSTRACT

A condenser microphone includes a support pipe made of a metallic material; a microphone body supported on a front end side of the support pipe, and including a microphone unit and an output module part having a sound signal output circuit and a shield housing; a proximal housing having an output connector therein and attached to a rear end side of the support pipe; a connecting member arranged between the support pipe and the shield housing; and a metal cover arranged in the connecting member and having a peripheral portion contacting with the shield housing. One end of a shield cover of a microphone cable and a ground part of the sound signal output circuit are connected electrically to the metal cover so that a complete shield in which a contact portion between the metal cover and the shield housing is a base point of grounding is formed.

5 Claims, 5 Drawing Sheets

CONDENSER MICROPHONE HAVING A FLEXIBLE NECK

CROSS-REFERENCE TO RELATED APPLICATION

The present application is based on, and claims priority from, Japanese Application Serial Number JP2010-35903, filed Feb. 22, 2010, the disclosure of which is hereby incorporated by reference herein in its entirety.

TECHNICAL FIELD

The present invention relates to a condenser microphone in which a microphone body is supported by a support pipe having flexibility. More particularly, it relates to a technique for preventing the generation of noise caused by electromagnetic waves radiated from a cellular phone or the like.

BACKGROUND ART

Gooseneck condenser microphones (hereinafter, referred sometimes to as a "condenser microphone") are used favorably in conference halls for, for example, international conferences, TV studios, and the like because the appearance thereof is simple, and the angle and height thereof relative to a speaker can be adjusted easily.

The gooseneck condenser microphones come substantially in two types: one is a separate type in which a microphone unit and an output module part are separated from each other (refer to FIG. 3), and the other is an integral type in which the microphone unit and the output module part are connected to each other (refer to FIG. 4).

A separate type condenser microphone A shown in FIG. 3 is configured so that a condenser microphone unit (hereinafter, referred sometimes to as a "microphone unit") 10 and an output module part 20 including a sound signal output circuit board 21 for the microphone unit are separated from each other. The microphone unit 10 is supported on the front end side of a support pipe 30, and the output module part 20 is attached to the rear end (proximal end) side of the support pipe 30.

The support pipe 30 includes a flexible shaft 31. In this example, the flexible shaft 31 has a front end-side flexible shaft 31*a* and a rear end-side flexible shaft 31*b*, and a junction pipe 32 consisting of a metallic straight tube is interposed therebetween. The output module part 20 has a shield housing 20*a*, and is placed on a base such as a table via a fixing device (not shown).

The microphone unit 10 and the sound signal output circuit board 21 of the output module part 20 are connected electrically to each other via a microphone cable 40 inserted through the support pipe 30. As the microphone cable 40, a two-core shield covered cable is used. Also, in the separate type, an output connector 22 is incorporated in the output module part 20 together with the sound signal output circuit board 21.

Usually, as the output connector 22, an output connector having No. 1 pin for grounding, No. 2 pin on the hot side of a signal, and No. 3 pin on the cold side thereof, which are specified in EIAJ RC-5236 "Latch Lock Type Round Connector for Audio Equipment", is used.

Although not shown in FIG. 3, a field effect transistor (FET) serving as an impedance converter is mounted in the microphone unit 10. In the case of separate type, the microphone cable 40 is an unbalanced transmission line. On the microphone unit 10 side, one core wire of the microphone cable 40 is connected to the drain side of the FET as a power source line, the other core wire thereof is connected to the source side as a signal line, and a shield cover conductor is connected to a unit case on the ground side. The source of the FET is also connected to the unit case (ground).

On the other hand, on the output module part 20 side, the power source line and the signal line of the microphone cable 40 are connected to predetermined terminals of the sound signal output circuit board 21, and the shield cover conductor is connected to the ground (grounded circuit) of the sound signal output circuit board 21. The ground of the sound signal output circuit board 21 is connected to the No. 1 pin of the output connector 22, and the No. 1 pin is also connected to the shield housing 20*a* of the output module part 20. That is, the No. 1 pin is the base point of grounding.

The output connector 22 is connected to a phantom power source via a balanced two-core shielded cable (both not shown). The output module part 20 is sometimes called a power module part because it supplies power to the microphone unit 10.

In contrast, an integral type condenser microphone B shown in FIG. 4 includes a microphone body M configured so that the microphone unit 10 and the output module part 20 are connected to each other, and the microphone body M is supported by the front end side of the support pipe 30. To the rear end side of the support pipe 30, a proximal housing 50 having only the output connector 22 is attached.

In this condenser microphone B, the sound signal output circuit board 21 in the output module part 20 and the output connector 22 in the proximal housing 50 are connected electrically to each other via the microphone cable 40.

In the case of the integral type, the microphone cable 40 is a balanced transmission line. On the output module part 20 side, the hot-side signal line and the cold-side signal line of the microphone cable 40 are connected to the drain side and the source side of the FET, respectively, via a predetermined wiring of the sound signal output circuit board 21, and the shield cover conductor is connected to the ground of the sound signal output circuit board 21. The source of the FET and the ground of the sound signal output circuit board 21 are connected to the shield housing 20*a* on the ground side.

On the other hand, on the proximal housing 50 side, the hot-side signal line and the cold-side signal line of the microphone cable 40 are connected to the No. 2 pin and the No. 3 pin of the output connector 22, respectively, and the shield cover conductor is connected to the No. 1 pin. The No. 1 pin is also connected to the proximal housing 50, so that in this condenser microphone B as well, the No. 1 pin is the base point of grounding.

In this example, the support pipe 30 consists of the rear end-side flexible shaft 31*b* and the junction pipe 32. In the rear end portion of the shield housing 20*a* of the output module part 20, a metallic coupler (connecting member) 20*b* is provided, and the output module part 20 is connected to the junction pipe 32 via the coupler 20*b*.

In both of the above-described separate type condenser microphone A and integral type condenser microphone B, the support pipe 30 and the shield covered cable of the microphone cable 40 function as antennas and are liable to pick up noise (disturbance electromagnetic waves) from the outside.

In addition, the flexible shaft 31 is produced by a coil spring consisting of a round wire rod made of steel or the like and a triangular wire rod made of a plastically deformable copper alloy or the like. The contact portions of these wire rods have impedance though having a low resistance value (for example, about 10Ω), so that in terms of high frequency, it cannot be said that the shield of the microphone cable 40 is complete.

Therefore, when a strong disturbance electromagnetic waves are applied to the microphone cable 40, the disturbance electromagnetic waves intrude into the microphone unit 10 and the output module part 20 as a high-frequency current, and are detected by a semiconductor device of the FET or the like, which results in the generation of noise.

In particular, from a cellular phone, considerably strong electromagnetic waves (for example, in the range of about several centimeters to several tens centimeters, field intensity reaching several ten thousands times the intensity of electric field generated in the city by commercial electric waves) are radiated, so that in the field of condenser microphone, an urgent need is to take measures against electromagnetic waves caused by the use of a cellular phone at close range.

Accordingly, concerning the separate type condenser microphone A shown in FIG. 3, the present applicant has proposed, in Japanese Patent Application Publication No. 2006-33216, a technique in which the skin (external sheath) of at least a portion where wiring is installed of the microphone cable inserted through the support pipe is removed to expose the shield cover conductor, and the shield cover conductor is brought into contact with the flexible shaft at multiple points, whereby the resistance value of flexible shaft is made a very small value to improve the shielding function against electromagnetic waves, and thereby the generation of noise caused by disturbance electromagnetic waves is restrained effectively.

The invention described in Japanese Patent Application Publication No. 2006-33216 is effective to some degree for the integral type condenser microphone B shown in FIG. 4 as well, but has a problem described below in the case of integral type.

In the integral type condenser microphone B, the ground (grounded circuit) of the sound signal output circuit board 21 in the output module part 20 and the ground base point (No. 1 pin) of the entire of microphone are separated from each other by the length of the support pipe 30, the support pipe 30 and the shield housing 20*a* of the output module part 20 are connected electrically to each other, and with the decrease in size of the microphone body M, which is a head unit, it becomes difficult to make the shield of portions of the housing complete. Therefore, the integral type condenser microphone B still has a problem of the generation of noise caused by disturbance electromagnetic waves.

Accordingly, an object of the present invention is to prevent noise from being generated in the integral type condenser microphone shown in FIG. 4 even if a cellular phone that radiates strong electromagnetic waves is used at close range.

SUMMARY OF THE INVENTION

To achieve the above object, the present invention provides a gooseneck condenser microphone including a support pipe made of a metallic material; a microphone body supported on a front end side of the support pipe; and a proximal housing having an output connector therein and attached to a rear end side of the support pipe, in which the microphone body includes a microphone unit and an output module part, the output module part incorporating a sound signal output circuit for the microphone unit in a shield housing; a connecting member to the support pipe is provided on a rear end side of the shield housing; and the sound signal output circuit and the output connector are connected electrically to each other via a microphone cable consisting of a two-core shield covered cable inserted in the support pipe, wherein a metal cover which has a core wire inserting hole in the central portion thereof and the peripheral portion of which is in contact with the shield housing is arranged on the rear end side of the shield housing; core wires of the microphone cable are pulled into the shield housing through the core wire inserting hole and are connected to predetermined terminals of the sound signal output circuit; both of one end of a shield cover conductor of the microphone cable and a ground part of the sound signal output circuit are connected electrically to the metal cover; another end of the shield cover conductor is connected electrically to a ground terminal of the output connector; and the shield housing and the support pipe are insulated electrically from each other.

In the present invention, a plastically deformable sleeve extending toward the support pipe side is preferably provided integrally around the core wire inserting hole of the metal cover.

Also, in order to electrically insulating the shield housing and the support pipe from each other, the mode may be such that an electric insulating material is interposed between the connecting member and the support pipe, or the mode may be such that the connecting member itself has an electric insulating property.

According to the present invention, in the gooseneck condenser microphone configured so that the microphone body in which the microphone unit and the output module part are integrated with each other is supported by the support pipe, on the shield housing of the output module part connected to the support pipe via the connecting member, the metal cover for closing the rear end side of the shield housing is put; the shield cover conductor of the microphone cable and the grounding part of the sound signal output circuit are connected electrically to the metal cover; and the shield housing and the support pipe are insulated electrically from each other, whereby the shield of the output module part, in which the contact portion between the metal cover and the shield housing is the base point of grounding, is completed, so that the inflow of a high-frequency current into the microphone body caused by disturbance electromagnetic waves can be prevented.

DETAILED DESCRIPTION

An embodiment of the present invention will now be described with reference to FIGS. 1A and 1B. The present invention is not limited to this embodiment. In the explanation of this embodiment, the same symbols are applied to elements that are essentially the same as the elements of the conventional example explained before.

Figure 1A:
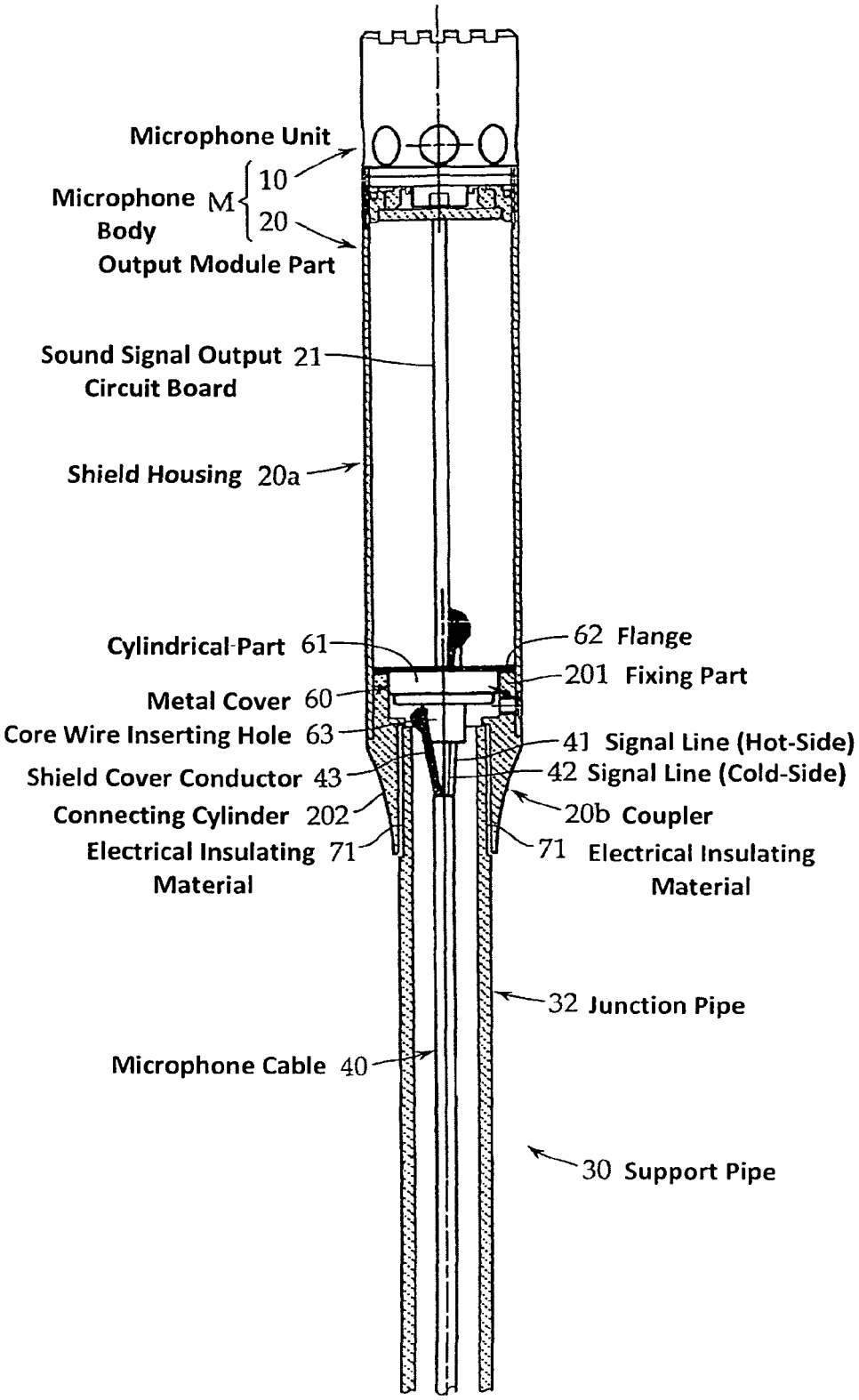
FIG. 1A is a sectional view of a microphone body that is an essential portion of a condenser microphone in accordance with the present invention.
Figure 1B:
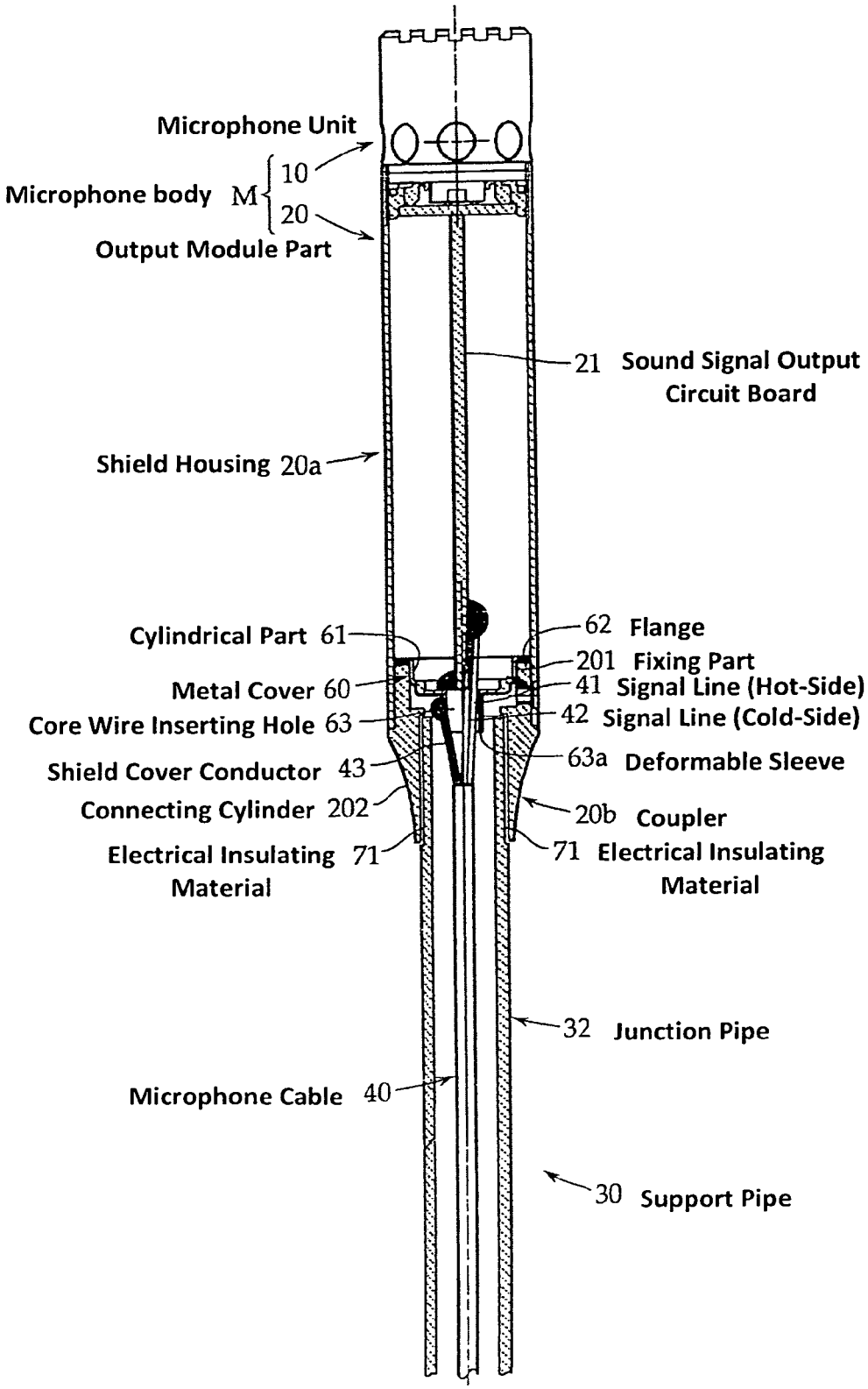
FIG. 1B is a sectional view of the microphone body shown in FIG. 1A, in which a metal cover in the microphone body is further shown as a section.

Referring to FIGS. 1A and 1B, because of being of the integral type explained before with reference to FIG. 4, a condenser microphone in accordance with this embodiment includes a microphone body M configured so that a microphone unit 10 and an output module part 20 are connected to each other, and the microphone body M is supported by the front end side of a support pipe 30.

Figure 4:
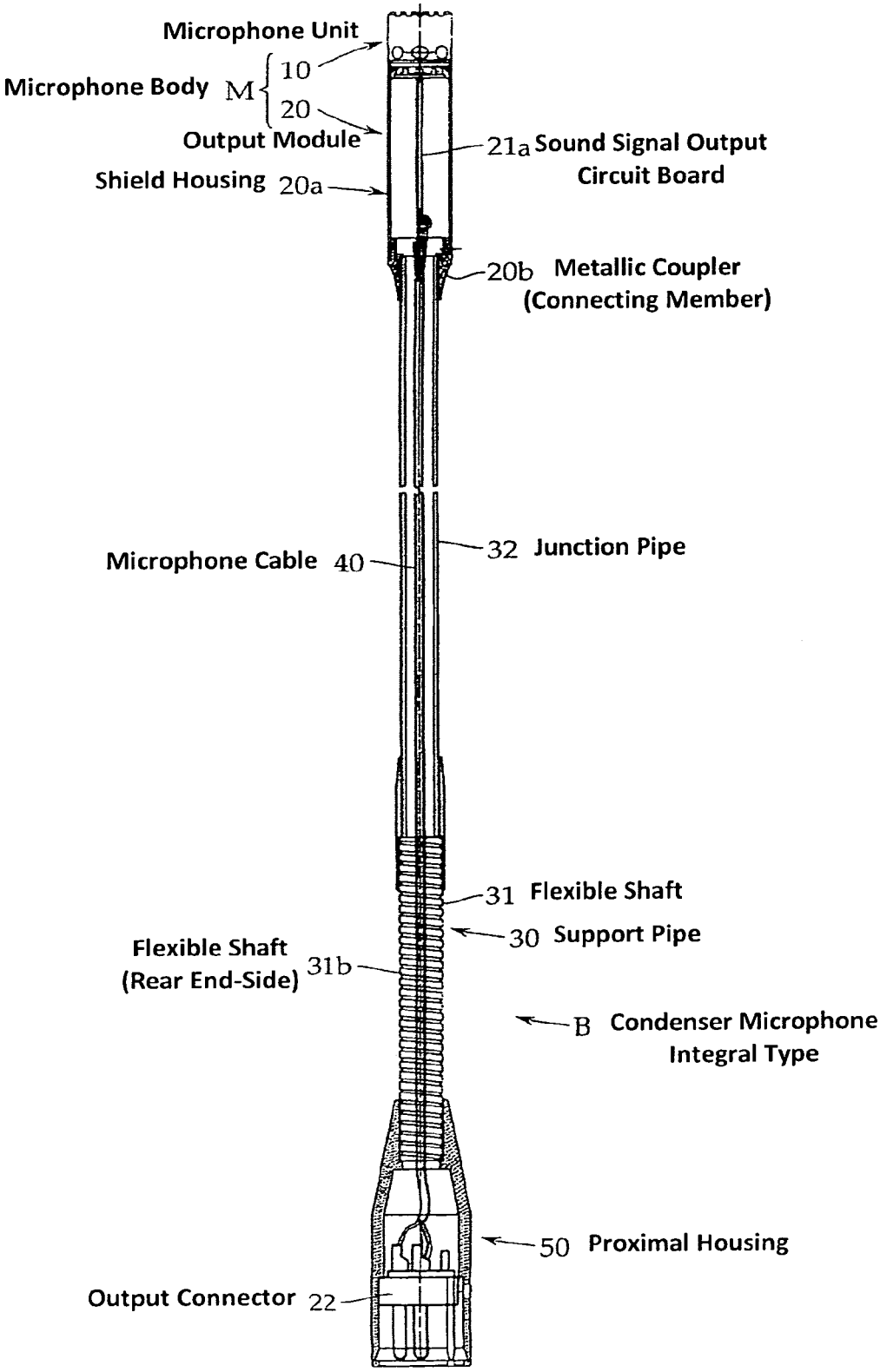
FIG. 4 RELATED ART
FIG. 4 is a sectional view for explaining the configuration of an integral type condenser microphone.

Although FIGS. 1A and 1B do not show the rear end side (proximal end side) of the support pipe 30, to the rear end side of the support pipe 30, a proximal housing 50 having an output connector 22 is attached integrally as shown in FIG. 4.

Although not shown in the figures, in the microphone unit 10, an acousto-electric converter configured so that a diaphragm and a backplate are arranged oppositely via a separator and an FET serving as an impedance converter are incorporated. The microphone unit 10 is preferably exchangeable with respect to the output module part 20.

The output module part 20 has a cylindrical shield housing 20*a* made of a brass alloy or the like, and in the shield housing 20*a*, a sound signal output circuit board 21 for processing a sound signal sent from the microphone unit 10 in a predetermined manner and delivering the processed sound signal is housed. Although not shown in the figures, on the sound signal output circuit board 21, an amplification circuit, a filter circuit, a ground pattern (grounded circuit), and the like are formed.

On the rear end side of the shield housing 20*a*, a coupler (connecting member) 20*b* for attaching the output module part 20 to the support pipe 30 is provided. The coupler 20*b* is formed by a metallic cylindrical body, and has a fixing part 201 fitted in the shield housing 20*a* and screwed thereto and a connecting cylinder 202 in which the support pipe 30 is inserted.

Figure 3:
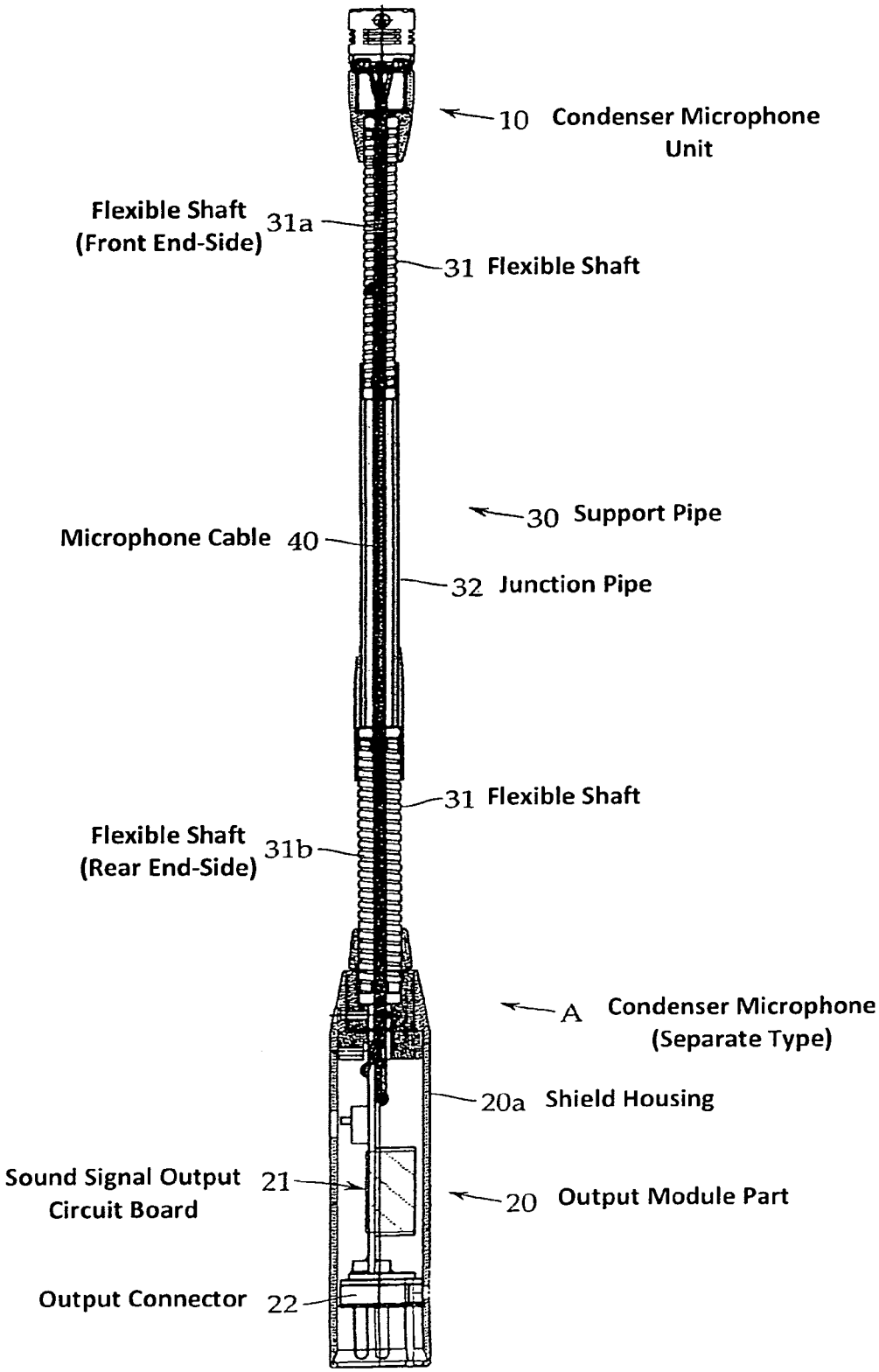
FIG. 3 RELATED ART
FIG. 3 is a sectional view for explaining the configuration of a separate type condenser microphone.

In this embodiment, in the connecting cylinder 202 of the coupler 20*b*, a junction pipe 32 of the support pipe 30 is inserted. In the case where the support pipe 30 has a configuration as shown in FIG. 3, a flexible shaft 31 is fitted in the connecting cylinder 202.

In the support pipe 30, a microphone cable 40 for electrically connecting the sound signal output circuit board 21 to the output connector 22 is inserted. As the microphone cable 40, a two-core shield covered cable having a hot-side signal line 41, a cold-side signal line 42, and a shield cover conductor 43 is used. The shield cover conductor 43 may be covered with a skin (external sheath).

In the present invention, as the shielding measures against disturbance electromagnetic waves, a metal cover 60 made of a brass material preferably gold-plated is provided on the rear end side of the shield housing 20*a*.

In this embodiment, the metal cover 60 has a cylindrical part 61 fitted in the fixing part 201 of the coupler 20*b*, and at the periphery of the cylindrical part 61, a flange 62 that is in contact with the end face of the fixing part 201 and the inner surface of the shield housing 20*a* is formed integrally.

In order to bring the flange 62 into tight contact with the inner surface of the shield housing 20*a*, that is, to electrically connect the flange 62 to the shield housing 20*a* reliably, it is preferable that the outside diameter of the flange 62 be slightly larger than the inside diameter of the shield housing 20*a*.

Also, the metal cover 60 has, in the central portion thereof, a core wire inserting hole 63 for inserting core wires (the power source line 41 and the signal line 42) of the microphone cable 40. In this embodiment, as a preferable mode, a plastically deformable sleeve 63*a* is formed integrally around the core wire inserting hole 63.

One end side of each of the hot-side signal line 41 and the cold-side signal line 42 of the microphone cable 40 is pulled into the shield housing 20*a* through the core wire inserting hole 63 of the metal cover 60, and is connected to a predetermined terminal of the sound signal output circuit board 21 by soldering or the like means. One end side of the shield cover conductor 43 is connected to the metal cover 60 by soldering or the like means.

The other end side of each of the hot-side signal line 41 and the cold-side signal line 42 of the microphone cable 40 is connected to No. 2 pin and No. 3 pin of the output connector 22, respectively, and the other end side of the shield cover conductor 43 is connected to No. 1 pin of the output connector 22.

The ground pattern (grounded circuit) of the sound signal output circuit board 21 is also connected electrically to metal cover 60. This connection may be made via a wiring material, or in some cases, may be made directly by soldering or the like means without the intervention of the wiring material.

Also, the coupler 20*b* and the junction pipe 32 (the support pipe 30) are insulated electrically from each other via an electrical insulating material 71. This electrical insulation can be made, for example, by putting a synthetic resin tube serving as the electrical insulating material 71 at the front end of the junction pipe 32 and by inserting it into the connecting cylinder 202. Besides, the coupler 20*b* itself may be made of a synthetic resin to be insulated electrically from the support pipe 30.

Thus, the metal cover 60 is arranged on the rear end side of the shield housing 20*b* of the output module part 20 so as to be in contact with the shield housing 20*b*, the shield cover conductor of the microphone cable 40 and the ground pattern of the sound signal output circuit board 21 are connected electrically to each other, and on the other hand, the shield housing 20*b* and the support pipe 30 are insulated electrically, whereby a completed shield in which the contact portion between the metal cover 60 and the shield housing 20*b* is the base point of grounding can be provided to the output module part 20.

Figure 2A:
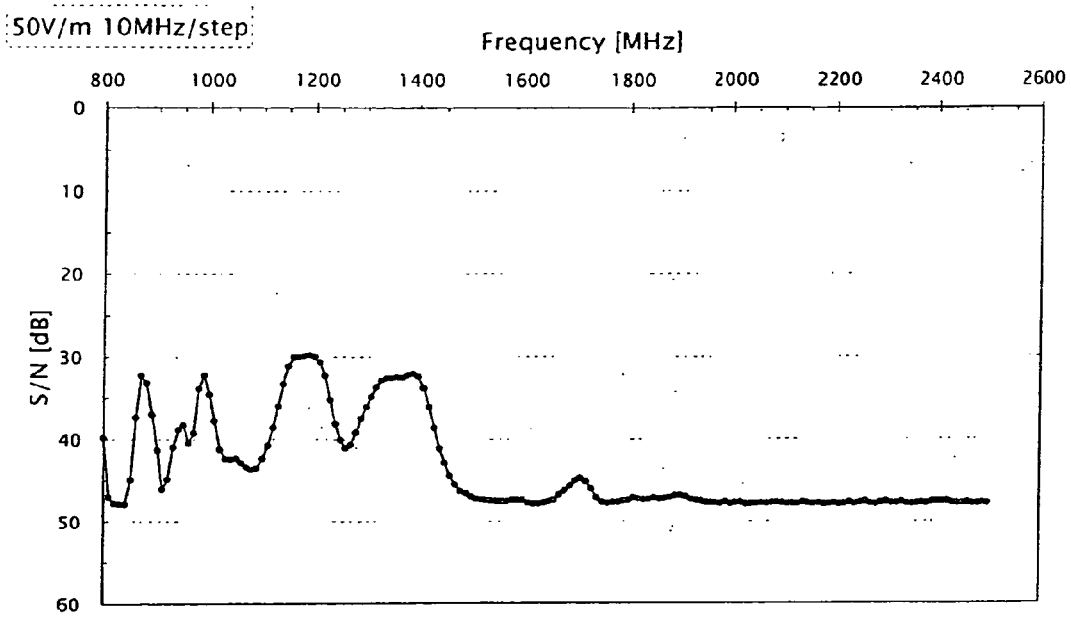
FIG. 2A is a graph showing characteristics of a condenser microphone with respect to electromagnetic waves in accordance with the present invention.
Figure 2B:
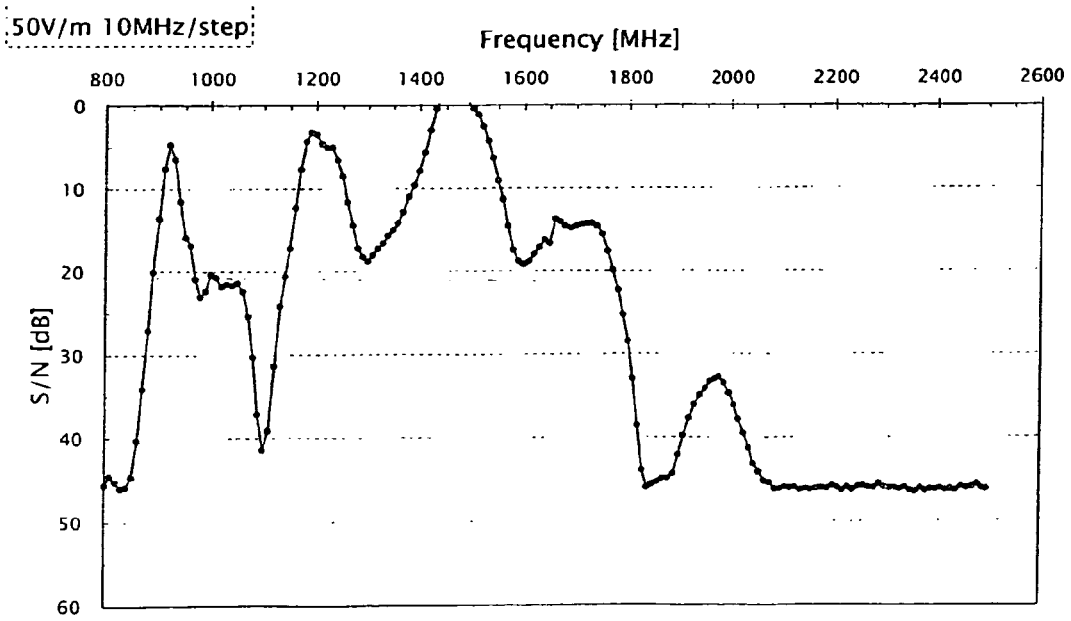
FIG. 2B RELATED ART
FIG. 2B is a graph showing characteristics of a condenser microphone with respect to electromagnetic waves in accordance with the prior art.

FIGS. 2A and 2B are graphs showing the measurement data of frequency response of the S/N ratio of noise and microphone sensitivity at the time when the condenser microphone of the mode shown in FIG. 1 in accordance with the present invention and the conventional condenser microphone of the mode shown in FIG. 4 are placed in an electric field in which electromagnetic waves AM-modulated at 1 kHz is 50 V/m, and the basic waves are changed in 10 MHz steps.

FIG. 2A shows the measurement data of the condenser microphone of the present invention, and FIG. 2B shows the measurement data of the condenser microphone of the conventional example. These figures reveal that according to the present invention, the frequency response of the S/N ratio is improved significantly as compared with the conventional example.

The metal cover 60 may be of a simple disc shape. However, the sleeve 63*a* is provided as in the above-described embodiment, and the sleeve 63*a* is staked after the insertion of core wires. This configuration can enhance the shieldability more, and contributes to the prevention of core wires from coming off.

The invention claimed is:

1. A condenser microphone comprising:

a support pipe made of a metallic material;

a microphone body supported on a front end side of the support pipe, and including a microphone unit, and an output module part having a sound signal output circuit for the microphone unit and a shield housing covering the sound signal output circuit;

a proximal housing having an output connector therein and attached to a rear end side of the support pipe;

a connecting member arranged between the support pipe and the shield housing;

a microphone cable electrically connecting the sound signal output circuit and the output connector and having two signal lines and a shield cover, inserted in the support pipe; and a metal cover arranged in the connecting member, and having a core wire inserting hole in the central portion thereof and a peripheral portion contacting with the shield housing, the microphone cable being pulled into the shield housing through the core wire inserting hole and connected to predetermined terminals of the sound signal output circuit, wherein one end of the shield cover of the microphone cable and a ground part of the sound signal output circuit are connected electrically to the metal cover so that a complete shield in which a contact portion between the metal cover and the shield housing is a base point of grounding is formed for the output module part;

another end of the shield cover is connected electrically to a ground terminal of the output connector; and the shield housing and the support pipe are insulated electrically from each other by an insulating material.

2. The condenser microphone according to claim 1, wherein a plastically deformable sleeve extending toward the support pipe side is provided integrally around the core wire inserting hole of the metal cover.

3. The condenser microphone according to claim 1, wherein the connecting member itself has an electric insulating property.

4. The condenser microphone according to claim 1, wherein the metal cover further comprises a cylindrical part fitted in the connecting member, and a flange, as the peripheral part, formed at one end of the cylindrical part and disposed on an end of the connecting member, the flange having a diameter greater than an inner diameter of the shield housing to be electrically connected thereto.

5. The condenser microphone according to claim 4, wherein the shield cover is fixed to the metal cover as well as the ground part of the sound signal output circuit.

* * * * *